United States Patent [19]

Schramer et al.

[11] Patent Number: 5,019,436

[45] Date of Patent: May 28, 1991

[54] LABEL ASSEMBLY AND METHOD OF MANUFACTURING

[76] Inventors: Kurt M. Schramer, 4267 Hile Rd., Stow, Ohio 44224; Alfred W. Norman, 158 Stonington Dr., Hudson, Ohio 44236; Kevin Nelson, 4725 Periwinkle Ct., Appleton, Wis. 54915

[21] Appl. No.: 246,080

[22] Filed: Sep. 19, 1988

[51] Int. Cl.[5] ..... G09F 3/00

[52] U.S. Cl. ..... 428/40; 40/638; 156/244.11; 156/244.16; 156/247; 428/202; 428/916

[58] Field of Search ..... 40/638; 156/244.11, 156/244.16, 247; 428/40, 202, 916

[56] References Cited

U.S. PATENT DOCUMENTS

| | | | |
|---|---|---|---|
| 4,133,939 | 1/1979 | Bokerman et al. | 428/447 |
| 4,211,021 | 7/1980 | Amprim et al. | 40/638 |
| 4,479,838 | 10/1984 | Dunsirn et al. | 428/352 X |
| 4,582,736 | 4/1986 | Duncan | 428/40 |
| 4,617,207 | 10/1986 | Ueki et al. | 428/40 X |
| 4,626,460 | 12/1986 | Duncan | 428/40 |
| 4,724,166 | 2/1988 | de Bruin | 428/352 X |
| 4,772,512 | 9/1988 | Nagafuchi | 40/638 X |
| 4,872,707 | 10/1989 | de Bruin | 156/247 X |
| 4,888,075 | 12/1989 | Freedman | 428/202 X |

*Primary Examiner*—Henry F. Epstein

*Attorney, Agent, or Firm*—Oldham & Oldham Co.

[57] ABSTRACT

A label assembly comprising a releasable portion which may be used as an in-store coupon constructed of a base stock having a first and second film layer having a controlled interfacial bond therebetween which will retain the film layers in integral relationship during handling or the like, but will also allow the easy separation between the film layers when desired. The controlled interfacial bond may be termed as "controlled adhesion" which is obtained by co-extruding two dissimilar polymer layers having a controlled affinity therebetween. A pressure sensitive adhesive layer is laminated to the second film layer and is provided with a release liner for the easy handling thereof. A face stock comprising a top sheet forming an in-store coupon, for example, is then adhered to the first film layer of the base stock structure to complete the label assembly. The releasable portion may be removed from the label assembly by breaking the controlled interfacial bond between the two film layers leaving no tacky or sticky surfaces behind, and allowing a clear, unobstructed view of the primary label graphics and coupon or other information on the releasable portion. The label assembly may be manufactured in an easy and cost effective manner and is suitable for various uses such as providing a controlled surface for reclosing a product container or as a tamper evident container closure assembly.

23 Claims, 2 Drawing Sheets

FIG.-3

LABEL ASSEMBLY AND METHOD OF MANUFACTURING

TECHNICAL FIELD

This invention relates to label assemblies and the structure thereof including the method of manufacturing the same. In one of its aspects the invention relates to instantly redeemable coupons which are applied to containers by means of a pressure-sensitive adhesive construction and which can be removed for redemption at the time of purchase of the product container. In general, the invention relates to a label assembly which may be adhesively applied to articles and comprises a peelable portion constituting a coupon or the like which is firmly secured to the label assembly but is easily removed by a consumer when desired. It is also a feature of the present invention that when the coupon is removed from the label assembly there remains no adhesive on the exterior surfaces of the coupon or label itself which remains adhered to the article or product container. In another of its aspects the invention relates to methods of manufacturing and using label assemblies.

BACKGROUND OF THE INVENTION

There is known generally in the prior art labels or the like, which are adapted to be attached to the surface of articles or product containers which include a peelable coupon which can be removed intact by the consumer. A common use of such label assemblies is seen with store coupons that are attached to product containers on the shelf and are detached and used by the consumer at the time of the purchase. The redeemable coupons associated with the label assembly are used to promote the product and increase sales in a relatively low cost and convenient manner. Previously coupons have been printed on the article or the product container such that it could be cut from the container and used in the next purchase of the product. In another technique, the coupon was placed in the container itself requiring consumption of the product before the coupon could be obtained and used.

The more recent label assemblies which include coupons or the like adapted to be attached to the surface of a product container such that the coupon may be removed and used by the consumer at the time of purchase of the product are found to be most desirable. Such a technique gives the consumer more incentive to purchase the product and receive a discounted price via use of the coupon attached to the label assembly at the time of purchase, in a very convenient and easy manner.

Some known coupon structures have previously utilized pressure-sensitive adhesive constructions wherein the adhesive has been pattern or zone coated such that the coupon lies on an uncoated portion and is attached coated portions of the label via perforations. When use of the coupon is desired the perforations are ruptured to release the uncoated coupon. In the last label assembly described, it is desirable, in order to achieve the advantages of the removable coupon, that the coupon and label assembly do not have tacky or sticky adhesive material on surfaces handled by the consumer. If such surfaces were sticky, this would create an annoyance in the use of the coupon and would be a practical disadvantage in many instances. Thus, the desirable feature of providing a removable coupon without leaving a sticky surface on the article, coupon or label has been achieved in the prior art by means of such pattern coating or more recently by use of dry residue adhesives applied to the coupon and label assembly such that the coupon is retained on the label assembly until removal thereof is desired. One example of such a system is shown by Dunsirn et al. in U.S. Pat. No. 4,479,838.

Another label assembly is shown by deBruin in U.S. Pat. No. 4,724,166 which shows instantly redeemable coupons, wherein the coupon is coated with a first and second dry coating thereon and is then secured to a base stock material by means of a pressure-sensitive adhesive layer. The first and second dry coating layers are incompatible such that in combination they act as a release coating which separates at the interface of the two layers. Thus, the coupon may be separated from the label assembly with no tacky or sticky surfaces as desired.

Another problem associated with the releasable coupon label assembly is found in that the base or primary label material should be clearly visible in a continuous, unobstructed manner after the releasable coupon has been removed from the label assembly. Additionally, printing upon the back side of the coupon itself should be visible in the same manner. The prior art has shown various schemes for generally meeting these advantages, but the resulting assemblies are relatively complex and expensive, making the extensive use of such releasable coupons somewhat impracticable.

It has thus been found to be desirable to provide a label assembly which avoids the mechanical approaches of the prior art in perforating, pattern gumming, or applying a dry residue adhesive, varnish or the like. A much simplified construction of the label assembly makes manufacture thereof easy and inexpensive, thereby facilitating use of releasable coupons in a label assembly.

SUMMARY OF THE INVENTION

In accordance with the above described desirable features, it is one objective of this invention to provide an improved label assembly including a releasable portion such as a coupon or the like. The label assembly may be attached to a product container or other article such that the releasable portion or coupon will be carried with the product container or article until removal of the coupon is desired.

Another object of the present invention is to provide a label assembly having a removable portion such as a coupon, which upon removal leaves no sticky or tacky surfaces and is therefore convenient to use.

It is yet another object of the present invention to provide a label assembly in which a releasable portion such as a coupon is constructed such that when the coupon is removed from the label assembly, a clear, unobstructed label remains for identifying the product or the like so as not to interfere with the aesthetics of the package. It is also an object of the present invention to provide the coupon or removable portion with printing or the like thereon which is not effected during its removal from the label assembly.

It is a further object of the present invention to provide a label assembly having a releasable portion thereon which achieves the advantages and objects mentioned hereinabove and which may be manufactured in a simplified and less expensive manner than heretofore found in the prior art.

It is yet another object of the invention to provide a label assembly which may be advantageously utilized to perform a variety of functions when adhered to a product container or other article.

These and other objects of the present invention are achieved by a label assembly which comprises a face stock material on which may be printed product, coupon, or other information. The face stock material is laminated to a base stock which includes means for releasably securing the face stock material thereon. The base stock structure comprises a first film layer of a polymeric material or the like. A second film layer is adhered to the first film layer by means of a phenomena which may be termed as "controlled adhesion". It is of particular significance in the present invention that the first and second film layers are not adhered by means of an adhesive per se, but proper adherence is achieved by a controlled interfacial bond between two dissimilar polymer materials as the materials are co-extruded in a melt process. The resulting controlled interfacial laminate provides a bonding strength between the films sufficient to retain the films in integral relationship until separation is desired. On the other hand, separation is easily accomplished by a minimum of force being applied to the first film by a consumer or the like.

The co-extruded two film structure is simply adhered to a label sheet stock or the article itself by means of a pressure sensitive adhesive applied to the second film layer of the base stock. It can be seen that there is no limitation on label shape or size as the base stock material is provided with a complete layer of pressure sensitive adhesive for the application thereof. Such a base stock structure also facilitates ease of manufacture and customizing capabilities as no pattern coating of adhesive is necessary and the resulting structure is easily die-cut to any specifications.

The simplified label assembly structure is more easily manufactured than the methods found in the prior art, for less steps are required and all steps may be performed as an in-line process by conventional high-speed label application equipment. Thus, the simplified construction of the label assembly along with the ease in manufacture produce a quick and cost effective system which makes the use of instantly redeemable coupons by the manufacturers feasible.

The invention provides a label assembly having a removable portion such as a coupon or other type of label which is easily and economically produced. The removable portion of the label assembly will not leave a tacky or sticky surface upon removal thereof, and will act as a "controlled" surface which may be used to temporarily reclose a product container. The label assembly may also be used as a tamper evident closure structure or in another manner. The invention achieves these desirable features with a simple structure which may be manufactured with a minimum of processing steps in an in-line process which may be accomplished by conventional high-speed label application equipment.

BRIEF DESCRIPTION OF THE DRAWINGS

The above-described objects and advantages of the present invention will become readily apparent from the following detailed description of the preferred embodiments of the present invention made in reference to the accompanying drawings wherein.

DETAILED DESCRIPTION OF THE INVENTION

Figure 1:
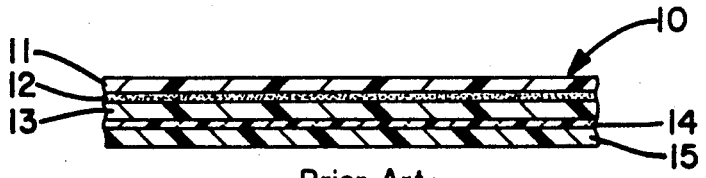
Prior Art FIG.-1
FIG. 1 is an enlarged side elevation view of a label assembly including a removable portion such as a coupon, which may be found in the prior art.
Figure 2:
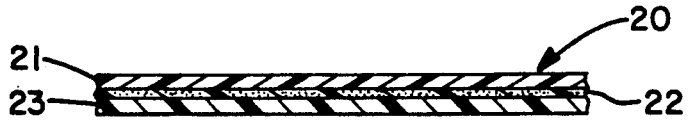
Prior Art FIG.-2
FIG. 2 is an enlarged side elevation of a coupon face stock assembly used with the label assembly of FIG. 1 as found in the prior art.

Referring now to the drawings, the preferred embodiment of the present invention will be described in more detail for a clear understanding of the invention and its scope. As seen in FIGS. 1 and 2, a label assembly comprising a removable portion or coupon which is releasably attached thereto which is generally known in the prior art is shown. The label assembly is comprised of a base stock material indicated by 10. The base stock 10 comprises a top sheet or film layer 11 which is releasably adhered to a second sheet or film layer 13 by means of a dry residue adhesive 12. The two film layers 11 and 13 are laminated together by use of the dry residue adhesive and may comprise a clear material such that the mounting surface or label to which the coupon structure is applied may be visible after removal of the coupon. Another adhesive layer 14 may comprise a clear acrylic permanent adhesive which allows mounting of the base stock 10 onto an article or product container. A release liner 15 is laminated to the adhesive layer 14 to enable the base stock 10 to be stored and transported for subsequent application to the product container on which it is to be applied.

To complete the label assembly to allow removal of a portion thereof such as a coupon or the like, requires a face stock 20, which is to be applied to the base stock 10 of FIG. 1. The face stock 20 comprises an outer sheet 21 which may be printed on in the normal manner to form a coupon or the like. The top sheet 21 is laminated with a permanent adhesive 22 which allows for the application of the face stock material 20 to the base stock 10 shown in FIG. 1. The face stock 20 is also formed with a release liner 23 to allow handling thereof until lamination with the base stock 10 is desired.

In the final construction of the label assembly found in the prior art, the face stock 20 will be laminated to the base stock material 10 by means of permanent adhesive 22 applied to the top film layer 11 of the base stock 10. When removal of the coupon is desired, the dry residue adhesive 12 will allow separation of the two film layers 11 and 13 at their interface. Thus, the top sheet 21 of the face stock 20 laminated to the top film layer of the base stock 10 by means of adhesive layer 22 will separate from the second film layer 13 to form the releasable portion of the label assembly as desired. It is noted that the base sheet or film layer 13 will remain with the article or product container by means of permanent adhesive 14 laminated thereto.

The second film layer or base sheet 13 along with the top film layer 11 of the base stock material 10 are selected in conjunction with the dry residue adhesive 12 such that the adhesion of the second film 13 to the mounting surface via adhesive 14 is greater than the adhesion of the top sheet 11 to the base sheet 13 via the dry residue adhesive 12, to allow the top sheet 11 to be removed from the base sheet 13 as desired. Furthermore, the cohesion of the top sheet 21 of the face stock 20 to the top film layer 11 of the base stock material 10 is also greater than the cohesion between the two film layers 11 and 13, to allow the top sheet 21 to be removed as desired.

It is noted that the structure of this label assembly requires several lamination steps in the manufacture thereof along with the application of several layers of adhesive including the dry adhesive layer 12 between the two film layers 11 and 13. These lamination steps tend to increase the time necessary to construct the label assembly and inhibit the manufacture of the label assembly using conventional high-speed label application equipment. It is also noted that the dry residue adhesive 12 used in this structure, though providing a non-tacky surface which remains on the article or product container along with the coupon itself, tends to cloud or mask the printing beneath it which is desired to be clearly visible and unobstructed.

Figure 3:
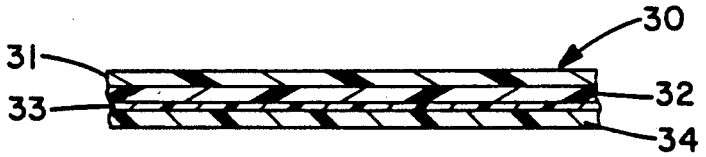
FIG. 3 is an enlarged side elevational view of the base stock material of the label assembly in the present invention allowing removal of a portion thereof.

A label assembly in accordance with the present invention will now be described with reference to FIGS. 3 and 4. A simplified label assembly allowing for the removal of a portion thereof to form a coupon or the like, is comprised of a base stock 30 having a simplified construction which is easily manufactured. The base stock 30 comprises first and second film layers 31 and 32 which may be formed of polyfilm materials. For example, the film layer 31 may be a polyester material which is extruded as a sheet which may be easily and precisely controlled to desired specifications. The second film layer 32 comprises a dissimilar polymer such as a nylon material, which again is extruded as a sheet the specifications of which are easily controlled.

It has been found that a controlled interfacial bond between the first film layer 31 and the second film layer 32 may be achieved by co-extruding the two dissimilar polymers in a melt process. The materials used to form the first and second film layers of the base stock 30 are selected such that during co-extrusion the materials exhibit a controlled affinity to each other yielding a controlled interfacial laminate which has been found to be especially applicable to the use of removable in-store coupons as described. The controlled interfacial laminate of the present invention does not require the separate application of an adhesive layer between the two film layers as is found in the prior art. Thus, during manufacture or converting the steps of applying such an adhesive along with the subsequent lamination of the two film layers is unnecessary and reduces the time and expense of the manufacturing process. Additionally, it has been found that the controlled interfacial bond between the two film layers in the present invention does not require extensive process control to form a consistent and uniform structure, and, thus, does not rely on the skill of a press operator to control consistency of the product.

It has been found that the combination of two dissimilar polymer materials in a melt process during the co-extrusion thereof forms a bond between the film layers which is sufficiently strong to retain the two layers in integral relationship during the handling and application thereof, while allowing the layers to be easily separated when desired. It is noted that the co-extruded polymer materials forming the controlled interfacial laminate may be produced as a separate raw material or as an in-line process within the label assembly manufacturing process.

The base stock material 30 also comprises a clear acrylic or rubber permanent adhesive 33, preferably a pressure sensitive adhesive, which is applied to the bottom of the second film layer 32. A release liner 34 is applied to the adhesive layer 33 to facilitate handling of the base stock material 30. Turning now to FIG. 4, the complete label assembly of the present invention is shown in more detail. The label assembly 40 comprises a face stock material similar to that found in the prior art which may be varied depending on the application in which the structure is to be used. The face stock has a top sheet layer 41 on which coupon or other information may be printed which is adhered to the base stock material previously described by means of a clear pressure sensitive adhesive 42 applied to the bottom side thereof.

Thus, as can be seen, the top sheet 41 is bonded to the top or first film layer 31 of the base stock material previously described. The first and second film layers 31 and 32 form the controlled interfacial laminate of the present invention which is adhered to a mounting surface of an article or product container 46 by means of a clear adhesive layer 33. When removal of the top sheet layer 41 is desired, the controlled interfacial bond between the two film layers 31 and 32 may be easily separated to facilitate removal of top layer 41 comprising a coupon or the like. It is noted that by the elimination of the dry residue adhesive layer or similar bonding systems between the two film layers, the ease in manufacture is evident along with providing non-tacky surfaces on the removed coupon portion along with the portion of the label assembly left on the article or product container as is desired. It is also noted that the transparent films used in the base stock allow the primary package graphics on the article or product container to clearly show through in an unobstructed manner. The construction of the label assembly makes the use of instantly redeemable coupons both cost effective and consumer friendly.

Figure 5:
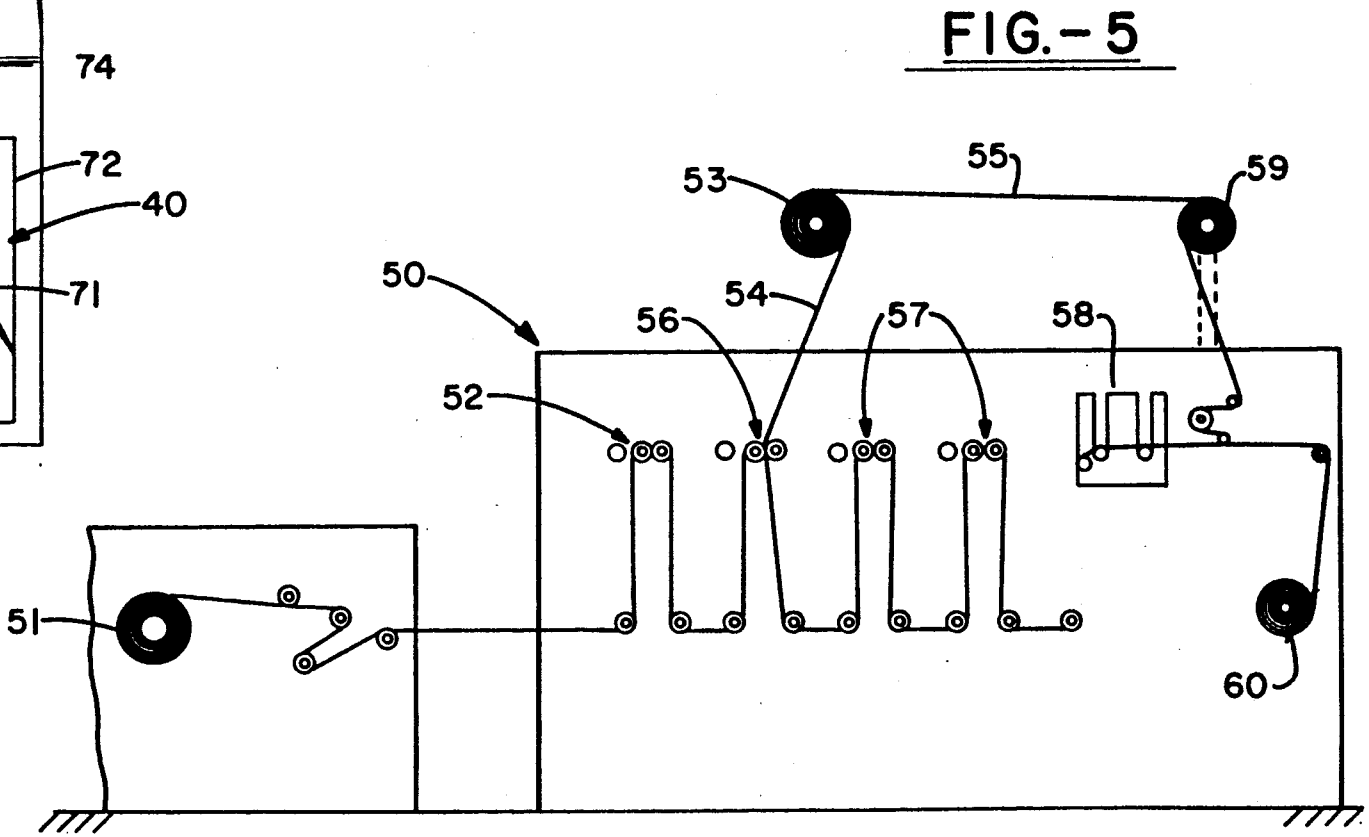
FIG. 5 is a schematic view of the manufacturing process in the present invention.

Referring now to FIG. 5, the manufacture of the label assembly of the present invention will be described in more detail. As generally indicated at 50, conventional high-speed diecut label manufacturing equipment is shown. In the manufacture of the label assembly of the invention, the base stock material as shown in FIG. 3 is used to start the manufacturing process at 51. The base stock 51 may be produced as a separate raw material as previously described. Alternately, the base stock may be produced by co-extrusion and adhesive lamination thereto as an in-line process in the label assembly manufacture. In FIG. 5, the base stock is shown as a separate raw material in roll form which is placed on an unwind stand and threaded through the high-speed label manufacturing equipment. Thus, in reference to FIG. 3 the first film layer 31 will be exposed in the application equipment. The top of the first film layer 31 may be printed on in reverse printing or inverted reverse at 52 of FIG. 5. In this way, upon removal of the coupon in the label assembly, coupon or other information may be observed on the reverse side thereof in a clear, protected and unobstructed manner. It is noted that the first film layer 31 of the base stock material is easily printed on by conventional printing equipment used in the art.

A face stock material similar to that shown in FIG. 2, is also loaded on an unwind stand at 53 and is set to be laminated to the base stock material in the application equipment. The adhesive side of the face stock material, comprising a pressure sensitive adhesive, is shown at 54, and the release liner is separated therefrom and shown at 55. The adhesive side of the face stock material is laminated to the base stock material in the application equipment at a print station as shown at 56.

Figure 4:
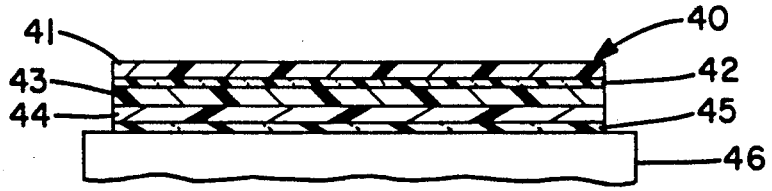
FIG. 4 is an enlarged side elevation of the label assembly in the present invention attached to a product container or other article.

At this point, a structure similar to that shown in FIG. 4 is achieved including a release liner on the bottom adhesive layer 45 of the label assembly. The upper surface of the face stock is then printed with coupon or other information at print stations 57 to basically complete the label assembly of the present invention. The label stock is then die cut and stripped using a sharp film die at 58. The waste from the stripping along with the release liner of the face stock material is rewound on a waste rewind stand at 59. The finished label assembly is then wound to form a roll stock for subsequent application to an article or product container at rewind stand 60.

It can be seen that the manufacture of label assembly in the present invention requires a minimum of application steps and may be achieved by use of conventional high-speed application equipment. It is also seen that the combination of the two component parts including the base stock and face stock material of the finished label assembly is accomplished on press and does not limit the label shape which may be desired. Both the base stock and face stock material have a complete layer of pressure sensitive adhesive on the bottoms thereof, such that any desired label may be customized by the product manufacturer without accommodating or working around pattern coated adhesives or perforations.

Figure 8:
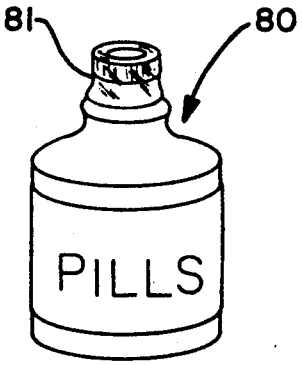
FIG. 8 is a perspective view of a product container utilizing the label assembly as a tamper evident closure structure.
Figure 7:
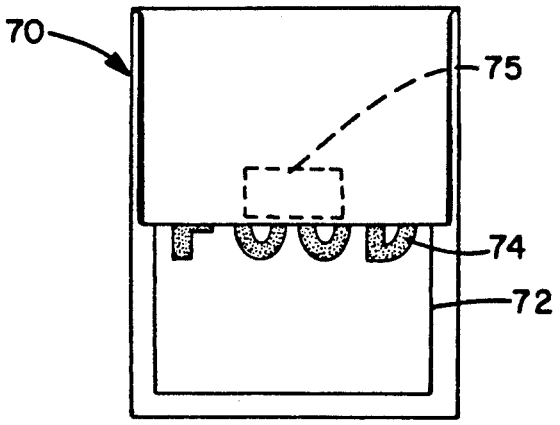
FIG. 7 is a perspective view of the product container as shown in FIG. 6 with the coupon removed from the label assembly and showing the reclosable feature of the present invention.
Figure 6:
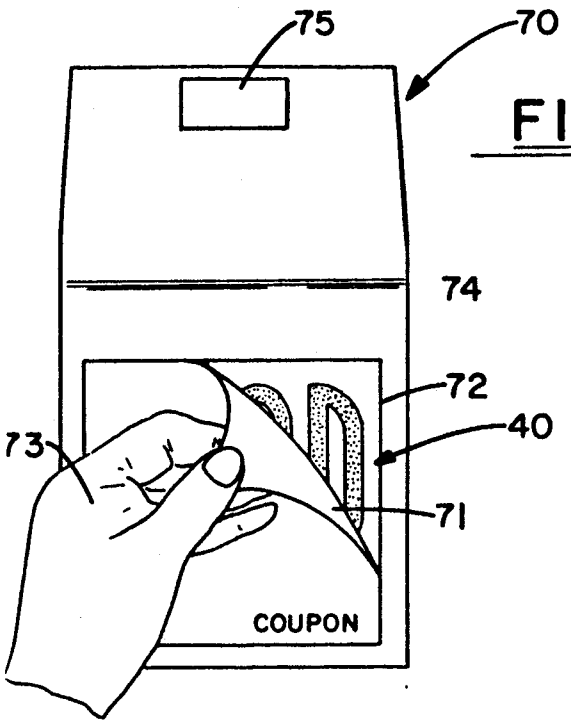
FIG. 6 is a perspective view of a product container having the label assembly of the present invention thereon and showing the removal of a portion thereof by a consumer.

Thus, in use the label assembly of the present invention may be suitable for many applications, a few of which are seen with reference to FIGS. 6–8. In FIG. 6, a common use of the label assembly of the present invention is to provide a releasable coupon which may be applied to any article or product container, and which does not have any tacky or sticky surfaces when removed from the label assembly. Additionally, the polymer films used as part of the base stock of the label assembly, provide an unobstructed and clear view of any material printed on the films themselves or the article or product container to which the label assembly is applied. Similarly, the label assembly may be used for temporary membership cards, rebates lottery tickets, temporary promotions or other similar applications depending on the face material which is used.

As shown in FIG. 6, the label assembly of FIG. 4, at 40 is applied to a product container 70. When the releasable portion of the label assembly is desired to be removed, a consumer as shown at 73 may simply peel off the releasable portion as shown at 71. The releasable portion 71 comprises the top sheet layer of 41 of the base stock material as shown in FIG. 4, along with the adhesive layer 42 and first film layer 43 of the face stock material. A portion of the label assembly is left on the product container 70, as shown at 72, which comprises the second film layer 44 which is non-releasably attached to the product container by means of adhesive layer 45. It can be seen that the primary label design or printing shown at 74 will be clearly visible once the releasable portion 71 of the label assembly is removed.

It is also a special feature of the label assembly in the present invention that once the releasable portion 71 is removed from the label assembly, the remaining portions 72 may act as a controlled surface for subsequent reclosing of the product container. This is important in protecting printed and delicate surfaces of the product container. As shown in FIG. 6, the product container 70 may include an area 75 having a pressure sensitive adhesive applied thereto. After the releasable portion 71 of the label assembly is removed, the pressure sensitive adhesive area 75 on the product container 70 may be folded over and adhered to the remaining portion 72 of the label assembly. Such a feature is depicted in FIG. 7 wherein the product container 70 once opened may be easily reclosed in a temporary fashion by merely applying an area 75 having a pressure sensitive adhesive thereon to the remaining portion of the label assembly 72. As the remaining portion 72 of the label assembly comprises only a film layer 44 as seen in FIG. 4, the area 75 having a pressure sensitive adhesive thereon may be releasably attached thereto repeatedly. Such a feature provides especially advantageous results for the consumer to keep the product within container 70 fresher and uncontaminated after initial opening of the container.

Additionally, the label assembly of the invention may be used as a tamper evident structure for use with product containers. It has more recently been found that tampering with products before they reach the consumer is a substantial problem which is desired to be avoided. As can be seen with reference to FIG. 8, a product container 80 is desired to be sealed with tamper evident packaging so that the consumer upon purchase of the product may be certain that the product container has not been tampered with. The label assembly of the present invention may be suitably attached around the opening of the container as shown at 81. In the event that someone attempts to tamper with the package 80, the releasable portion of the label assembly will first be removed from the product container. The second film layer left on the product container may comprise suitable printing warning the consumer that if this layer is seen, the product container has been tampered with and should not be used. Upon removal of the releasable portion of the label assembly, the person tampering with the product container will also be informed that such an attempt has failed, thereby dissuading any further or subsequent tampering.

The label assembly of the present invention provides a simplified and cost effective structure for use with instantly redeemable in-store coupons and other advantageous uses which may be manufactured in a fast and economical manner using conventional high-speed label manufacturing equipment. While the invention has been described with reference to specific embodiments, the description is illustrative only and is not to be construed as limiting the scope of the invention. Various modifications and changes may occur to those skilled in the art without departing from the spirit and scope of the invention as defined by the appended claims.

What is claimed is:

1. A label assembly having two parts comprising:

a base stock being constructed of first and second layers of polymer material having first and second surfaces, said first surfaces of each being bonded by controlled adhesion to each other to create a releasable interfacial bond therebetween;

said second layer of polymer material being provided with a first adhesive layer over its second surface for application to a mounting surface;

a face stock being constructed of a top sheet with first and second surfaces having a second adhesive layer over its second surface;

said face stock being adhered to said base stock on said second surface of said first layer of polymer material by means of said second adhesive layer;

a releasable portion being formed when said face stock is adhered to said base stock wherein said face stock and said first layer of polymer material are separable from said base stock wherein said interfacial bond has sufficient strength to allow handling of said label assembly without separation of said releasable portion until such separation is desired by breaking said releasable interfacial bond between said first and second layers of polymer material.

2. A label assembly according to claim 1, wherein:

said first and second layers of polymer material are dissimilar in composition.

3. A label assembly according to claim 1, wherein;

said controlled adhesion is obtained by co-extruding said first and second polymer layers to form a laminate.

4. A label assembly according to claim 2, wherein;

said first layer of polymer material is a polyester, and said second layer of polymer material is a nylon which when co-extruded show a controlled affinity for one another.

5. A label assembly according to claim 1, wherein:

said first and second layers of polymer material are printable and essentially transparent such that any graphics on said mounting surface or said layers of polymer material will be clearly visible upon separation of said base stock.

6. A label assembly according to claim 1, wherein;

upon separation of said releasable portion, no adhesive layer will be revealed such that all exposed surfaces of the label assembly are non-tacky.

7. A label assembly according to claim 1, wherein;

upon separation of said releasable portion, said first surface of said second layer of polymer material is exposed providing a controlled surface which may be used to releasably secure an adhesive layer thereon.

8. A label assembly according to claim 7 wherein;

said mounting surface is a product container;

said product container provided with an area having a pressure sensitive adhesive thereon which may be releasably secured to said controlled surface to essentially reclose said product container after initial opening thereof.

9. A label assembly according to claim 1, wherein;

said mounting surface is the opening of a product container such that said label assembly is utilized as a tamper evident closure structure, wherein evidence of tampering is shown by said releasable portion being removed.

10. A method of manufacturing a label assembly having two parts comprising:

co-extruding first and second layers of polymer material having first and second surfaces to form a laminate having a releasable interfacial bond between said first surfaces of said layers applying a first adhesive layer to the second surface of said first layer of polymer material such that said laminate is adapted to be adhered to a mounting surface;

providing a top sheet of material;

applying a second adhesive layer to a surface of said top sheet; and joining said top sheet to the second surface of said second layer of polymer material by means of said second layer of adhesive wherein said top sheet and said second layer of polymer material are removable by breaking said releasable interfacial bond.

11. A method of manufacturing a label assembly according to claim 10, wherein;

said first and second adhesive layers comprise a pressure sensitive adhesive.

12. A method of manufacturing a label assembly according to claim 10, wherein;

said first and second layers of polymer material are dissimilar in composition such that when co-extruded they show a controlled affinity to one another.

13. A method of manufacturing a label assembly according to claim 12, wherein;

said first layer of polymer material is a polyester and said second layer of polymer material is a nylon.

14. A method of manufacturing a label assembly according to claim 10, further comprising the steps of:

printing in reverse or inverted reverse on said upper surface of said second layer of polymer material before the step of joining with said top sheet.

15. A method of manufacturing a label assembly according to claim 10, further comprising the steps of:

die-cutting said label assembly after said step of joining to provide finished labels of any desired shape or size.

16. A method of manufacturing a label assembly according to claim 10, further comprising the steps of:

applying a release liner on said first adhesive layer such that said label assembly may be handled before application thereof to said mounting surface.

17. A label assembly according to claim 1, wherein:

said layers of polymer material can be printed on to provide graphic information viewable after separation of said releasable portion from said base stock.

18. A method of manufacturing a label assembly as in claim 10 further comprising the steps of printing graphic information on said second layer of polymer material before adhering said top sheet thereto to be viewable upon separation of said top sheet and said second layer from said first layer of polymer material.

19. A method of manufacturing a label assembly according to claim 10, wherein said layers of polymer material can be printed on to provide graphic information viewable after separation of said releasable portion from said base stock.

20. A method of manufacturing a label assembly as in claim 10, further comprising the steps of printing on one or both surfaces of said top sheet to provide graphic information viewable before or after separation of said sheet and said second layer from said first layer of polymer material.

21. A label comprising;

a base stock being constructed of first and second layers of polymer material having first and second surfaces, said first surfaces of each being bonded by controlled adhesion to each other to create a releasable interfacial bond therebetween;

said second surface of said first layer polymer material being printed with graphic material, and said second layer of polymer material being provided with a layer of adhesive over its second surface for application to a mounting surface;

a face stock being constructed of a top sheet with first and second surfaces having a layer of adhesive over its second surface so as to be adhered to said base stock on said second surface of said first layer of polymer material and having graphic material printed on said first surface of said face stock;

a releasable portion being formed when said face stock is adhered to said base stock wherein said face stock and said first layer of polymer material are separable from said base stock by breaking said releasable interfacial bond between said first and second layers of polymer material in said base stock.

22. A method for removably mounting a coupon on a mounting surface comprising the steps of:

1) providing a coupon structure comprising first and second layers of polymer material being bonded by controlled adhesion to create a releasable interfacial bond therebetween and having a top sheet adhered to said first layer of polymer material;

2) applying an adhesive to the underside of said second layer of polymer material;

applying and adhering said coupon structure to a mounting surface, whereby said top sheet and said first layer of polymer material may be removed from said second layer of polymer material by breaking said releasable interfacial bond between said first and second layers of polymer material, leaving said second layer of polymer material adhered to said mounting surface with both the removed portion of the coupon structure and the exposed second layer of polymer material being non-tacky and visually unobstructed.

23. A method of making a coupon structure comprising the steps of:

1) providing a backing web with a release surface;

2) providing a base stock by coextruding first and second layers of polymer material having first and second surfaces to form a laminate having a releasable interfacial bond between said first surfaces of said layers;

3) applying an adhesive layer to a bottom surface of said base stock such that said base stock is adapted to be releasably adhered to said backing web on said release surface;

4) providing a top sheet of material;

5) applying a layer of adhesive to a bottom surface of said top sheet;

6) applying said top sheet to said base stock by means of said adhesive layer on said top sheet, whereby said second layer of polymer material may be adhered to a mounting surface by means of said adhesive layer applied thereto upon removal of said backing web, and said top sheet and said first layer of polymer material are removable by breaking said releasable interfacial bond between said first and second layers of polymer material.

* * * * *